United States Patent [19]

Stahlecker

[11] Patent Number: 4,964,268

[45] Date of Patent: Oct. 23, 1990

[54] PROCESS AND AN ARRANGEMENT FOR THE PIECING OF A DOUBLE YARN AFTER A YARN BREAKAGE

[75] Inventor: Fritz Stahlecker, Bad Überkingen, Fed. Rep. of Germany

[73] Assignee: Hans Stahlecker, Suessen, Fed. Rep. of Germany; a part interest

[21] Appl. No.: 390,752

[22] Filed: Aug. 8, 1989

[30] Foreign Application Priority Data

Aug. 19, 1988 [DE] Fed. Rep. of Germany ..... 3828189

[51] Int. Cl.[5] ..... D01H 1/115; D01H 15/013

[52] U.S. Cl. ..... 57/261; 57/22; 57/328; 57/350

[58] Field of Search ..... 57/22, 261, 328, 350; 242/35.6 E

[56] References Cited

U.S. PATENT DOCUMENTS 3,236,464 2/1966 Wey ..... 242/35.6 E X
4,408,442 10/1983 Rohner ..... 57/22
4,445,317 5/1984 Mima ..... 57/22
4,494,368 1/1985 Mima ..... 57/22
4,570,427 2/1986 Premi et al. ..... 57/22
4,790,130 12/1988 Stahlecker et al. ..... 57/261

FOREIGN PATENT DOCUMENTS 3634464 4/1988 Fed. Rep. of Germany ..... 57/328

*Primary Examiner*—Joseph J. Hail, III
*Attorney, Agent, or Firm*—Evenson, Wands, Edwards, Lenahan & McKeown

[57] ABSTRACT

In a process and an arrangement for the piecing of a double yarn after a yarn breakage at a spinning unit of a spinning machine, which forms a double yarn from two prestrengthened yarns, which is wound onto a spool package, it is provided that, for a piecing, a newly spun double yarn is connected by means of splicing with an end of the double yarn withdrawn from the spool package, in which case, before the splicing, both double yarns are prestrengthened by being provided with a twist.

16 Claims, 2 Drawing Sheets

PROCESS AND AN ARRANGEMENT FOR THE PIECING OF A DOUBLE YARN AFTER A YARN BREAKAGE

BACKGROUND AND SUMMARY OF THE INVENTION

The invention relates to a process and an arrangement for the piecing of a double yarn after a yarn breakage at a spinning unit of a spinning machine having a plurality of spinning units which each contain devices for the prestrengthening of two yarns and devices for winding these yarns, as a double yarn, onto a spool package which is used as a feeding spool package for a subsequent twisting. A newly spun double yarn and an end of the double yarn withdrawn from the spool package are connected with one another by splicing for a piecing.

The double yarn, which consists of two only prestrengthened yarns, on the whole, has a relatively low strength, so that its handling is critical during a piecing operation and may easily result in a breaking of the newly spun double yarn or of the double yarn withdrawn from the spool package.

An object of the invention is to provide a process and an arrangement in which the danger of a tearing of the double yarns during a piecing attempt is reduced.

This object is achieved in that, before the splicing, the newly pieced double yarn as well as the double yarn withdrawn from the spool package are prestrengthened by being provided with a twist.

By means of this twist, the double yarns are at least partially strengthened so that their handling presents less of a risk.

In a further development of preferred embodiments of the invention, it is provided that the double yarn taken from the spool package and the newly spun double yarn, over at least approximately the same lengths, receive a twist which is, in each case, in the opposite direction with respect to one another. After the spliced connection is established, a yarn piece will then be obtained which is twisted in the opposite direction in front of and behind the spliced connection; i.e., it has a type of false twist. These twists may then cancel themselves out, so that Practically no twist is contained in the final product.

In another development of preferred embodiments of the invention, it is provided that the double yarn which is taken off the spool package, and the newly spun double yarn each receive a twist in the same direction which is opposite of the subsequent twisted-yarn twist. During the Piecing, i.e., when the spliced connection is established, both yarns therefore receive a twist in the same direction. This twist will be at least partially cancelled during the subsequent twisting operation.

In a further development of preferred embodiments of the invention, it is provided in an arrangement that the devices for the picking-up of the newly spun double yarn and the devices for taking the double yarn off the spool package each contain a suction gripper which is equipped with a pneumatic twisting device affecting the respective double yarn. By means of this construction, the pneumatic twisting devices can easily be integrated into the arrangement without the requirement of any additional space and mainly without the requirement of any additional work steps during the piecing.

In a further development of preferred embodiments of the invention, it is provided that the suction grippers are equipped with devices for producing a true twist in the respective ends of the double yarns. In this case, it will be expediently provided that the suction grippers are provided with devices for cutting the double yarn at a distance from their mouths. These devices each produce a free end of the double yarn, so that a true twist is produced in the part located in front of it.

Other objects, advantages and novel features of the present invention will become apparent from the following detailed description of the invention when considered in conjunction with the accompanying drawings.

DETAILED DESCRIPTION OF THE DESCRIPTION

Figure 1:
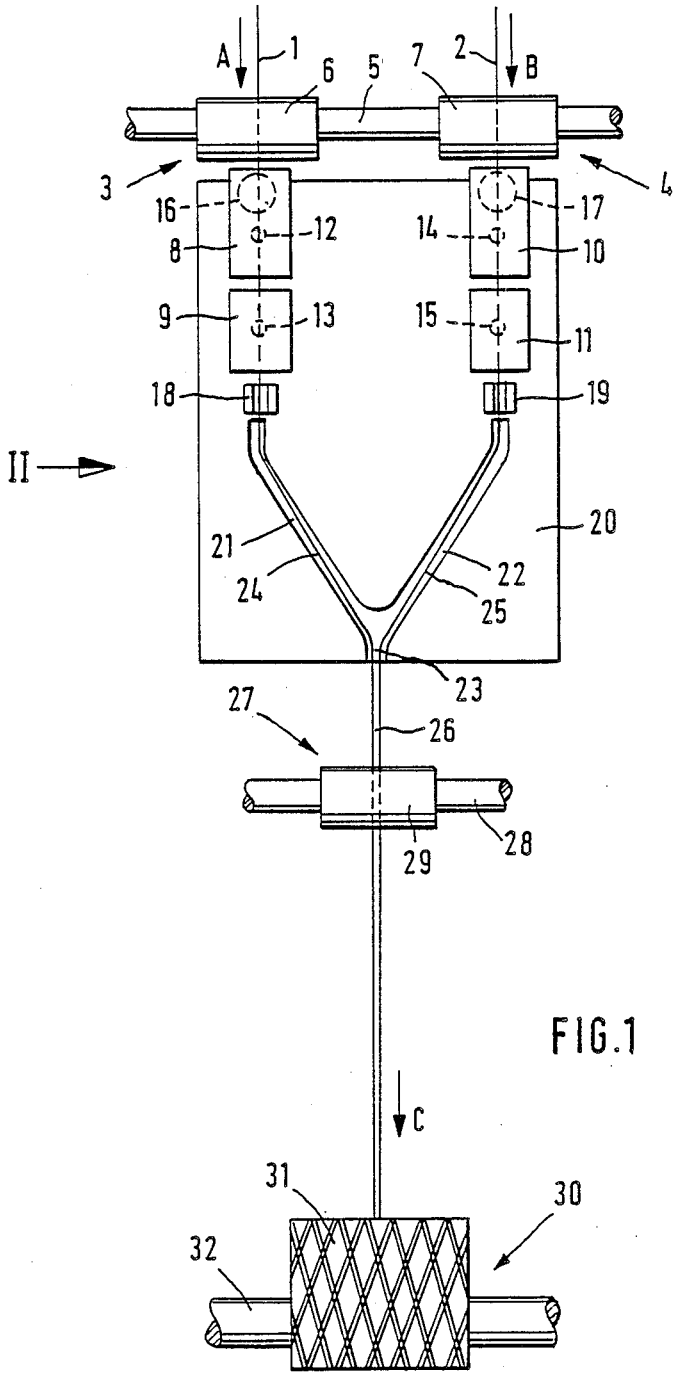
FIG. 1 is a schematic representation of a front view of an individual spinning unit of a spinning machine, constructed in accordance with a preferred embodiment of the invention.

Two slivers 1, 2 move into the spinning unit shown in FIG. 1 in the direction of the arrows (A) and (B). These slivers 1, 2, in a known manner, are drawn or drafted to the desired size in drafting units 3, 4, of which only the delivery rollers are shown. The delivery roller pairs consist of a driven bottom cylinder 5 extending through in the longitudinal direction of the machine as well as of pressure rollers 6, 7 which are each assigned to one of the drafting units 3, 4.

The drafting units 3, 4 are followed by pneumatic false-twisting devices which each consist of an intake nozzle 8, 10 and of a false-twisting nozzle 9, 11, which follows. Compressed-air lines 12, 13, 14, 15 lead to these nozzles 8, 9, 10, 11, which are connected, in a manner not shown in detail, by means of one or several valves to a compressed-air supply system. In the pneumatic false-twisting devices, the two slivers 1, 2 are prestrengthened, so that two prestrengthened yarns 24, 25 are produced. Although the false twist which is provided to the slivers 1, 2, opens up again behind the false-twisting devices, some fiber ends remain wound around the essentially untwisted fiber core.

The prestrengthened yarns 24, 25 are guided together in grooves 21, 22 of a base plate 20 which extend in a V-shape, so that these yarns 24, 25 leave the base plate at the end 23 of the two grooves 21, 22 while being disposed relatively close to one another and, in the process, form a double yarn 26. The double yarn 26 is withdrawn by means of a withdrawal device 27. The withdrawal device contains a driven cylinder 28, which extends through in the longitudinal direction of the machine, as well as, in each case, a pressure roller 29 which is pressed on elastically.

From the withdrawal device 27, the double yarn 26 moves in the direction of the arrow (C) to a wind-up device 30 by which it is wound up side-by-side onto a cross-wound spool package 31. Only that shaft 32 of the wind-up device 30 is shown which extends through in the longitudinal direction of the machine and by which the cross-wound spool package 31 is driven. Naturally, the wind-up device also contains other devices, such as a spool package frame which holds the spool Package 31, a cross-winding device for the double yarn 26 as well as a compensating device by means of which differences in length are compensated.

Figure 2:
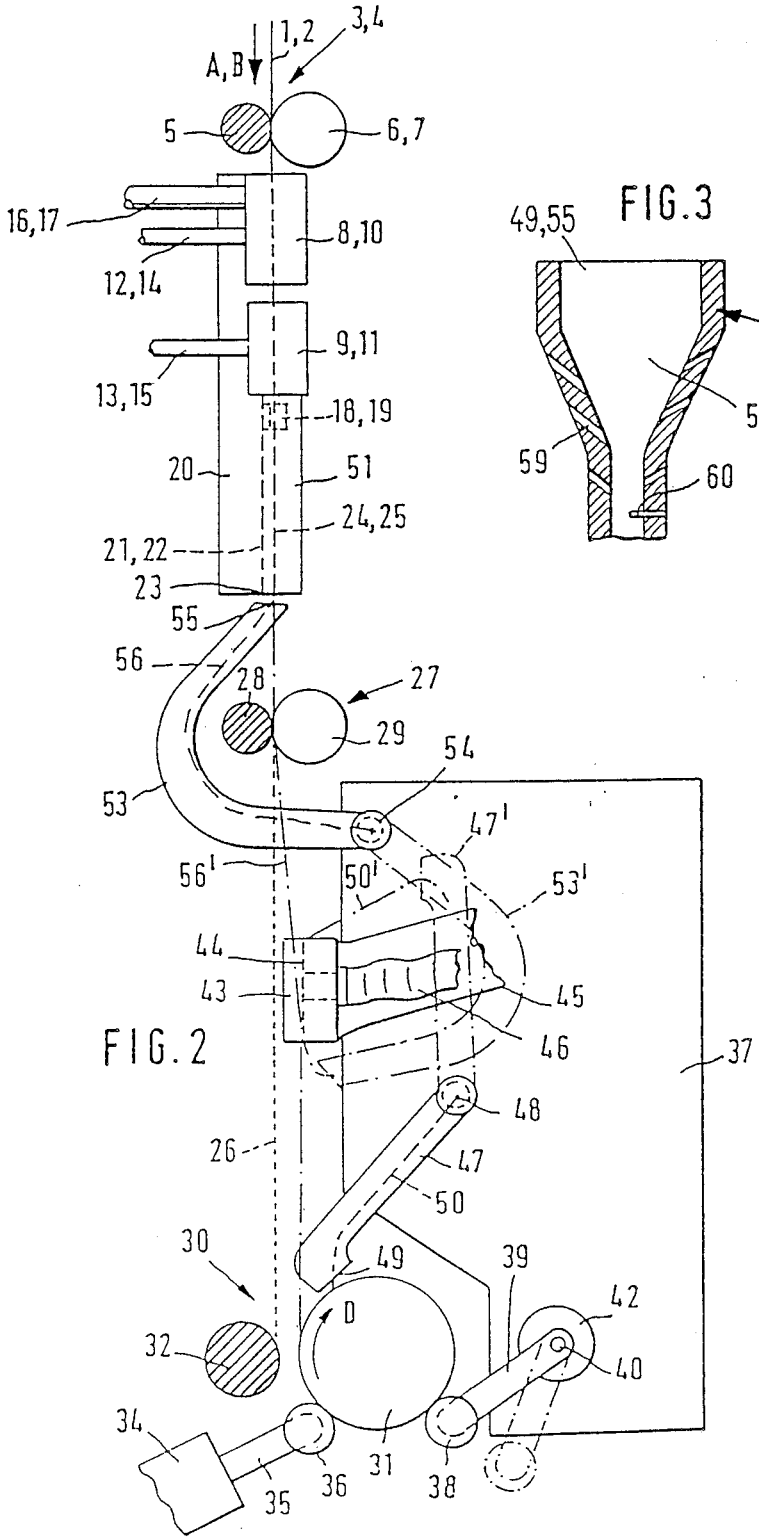
FIG. 2 is a lateral schematic view of the spinning unit of FIG. 1 and of a piecing arrangement operating at this spinning unit, constructed according to a preferred embodiment of the invention.

Air nozzles 8, 9, 10, 11 are fastened on the base plate 20. In the case of a yarn breakage, the base plate 22 is adjusted by means of an adjusting device in such a manner that suction nozzles 16, 17 connect to the delivery roller pairs of the drafting units 3, 4, which receive the continuously moving yarn components. The occurrence of a breakage of one of the two yarns 24, 25 is monitored by means of yarn detectors 18, 19 which are arranged directly behind the false-twisting nozzles 9, 11. In the case of a breakage of one or both yarns 24, 25, the drive of the spool package 31 is also interrupted. For this purpose, the spool package 31 is lifted off the shaft 32 by means of a pneumatic press 34. The piston 35 of the press 34, which can be moved out in the direction of the spool package 31, carries a lift-off roller 36 (FIG. 2).

The piecing operation is carried out bY means of a movable servicing apparatus 37 which, in a manner not shown in detail, can be moved along the spinning machine which has a plurality of identical spinning units, and which is applied to the respective spinning unit. The servicing apparatus 37 contains an auxiliary driving roller 38 for the spool package 31 which can be changed from the position shown by a dash-dotted line into the position in which it rests against the spool package 31. The auxiliary driving roller 38 is arranged on a swivel arm 39 which, by means of an adjusting drive 42, can be swivelled around a swivel shaft 40. The auxiliary driving roller 38, at a preferably controllable speed, can be driven in both rotating directions, i.e., in wind-up direction of the spool package 31 as well as in wind-off direction (arrow D).

In a manner not shown in detail, the servicing apparatus 37 causes the base plate 20 with the air nozzles 8, 9, 10, 11 to be returned into its operating position, so that the slivers 1, 2 will again move into the pneumatic false-twisting devices. The servicing apparatus, by means of a drive not shown in detail, applies a cover 51 to the base plate 20 by means of which the grooves 21, 22 are covered so that these form closed ducts and lead out at the end 23. A suction gripper 53 is applied by means of its mouth 55 to the end 23 of the covered ducts 21, 22.

The suction gripper 53 can be swivelled by means of a swivel drive which is not shown, around a hollow swivel shaft 54, which is connected to a vacuum source not shown in detail, between a dash-dotted position 53' and the position in which its mouth 55 connects to the end 23 of the two grooves 21, 22. The suction nozzle 53 takes in the newly spun double yarn 56 and, when it swivels into its position 53', it places this double yarn 56, in position 56', into a splicing arrangement 43 which has a splicing channel 44. The splicing arrangement 43 is shown only very schematically. It has other elements, particularly yarn guides or the like which provide a suitable position for the double yarn 56' and for the double yarn 50' to be connected with it. The splicing arrangement 43 is disposed on a holder 45 and, in manner not shown in detail, is connected to a compressed-air supply system 46 which is equipped with a control valve.

The servicing apparatus 37 contains a similar suction gripper 47 which can be applied by means of its mouth 49 to the circumference of the spool package 31. While the spool package 31 is driven in wind-off direction (arrow D) by the auxiliary driving roller 38, the suction gripper 47, which can be swivelled around a hollow shaft 48 connected to a vacuum source, takes in the end of the double yarn 50 already wound on the spool package 31. The suction gripper 47 will then swivel around the shaft 48 into position 47' shown by a dash-dotted line, in which case, it takes along the double yarn 50 and transfers it to position 50' in which this double yarn is also disposed in the longitudinal groove of the splicing arrangement 43.

Figure 3:
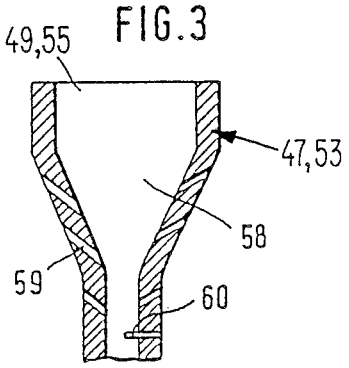
FIG. 3 is an enlarged sectional representation of a suction gripper equipped with false-twisting nozzles, constructed according to a preferred embodiment of the invention.

Both suction grippers 47 and 53 are equipped with pneumatic twisting devices by means of which the double yarns 50 and 56 are provided with a twist, while they are gripped by the suction grippers 47, 53. As shown by means of FIG. 3 for the suction grippers 47, 53 this twisting device consists of sloped bores 59 which are arranged approximately tangentially with respect to the interior wall of the suction gripper 47 and as a result generate an air whirl. If necessary, it may be provided that compressed air is blown into the openings 59. In order to achieve that a free end of the double yarn 50 is always located in the suction gripper 47, even if a fairly large length is already wound off, a cutting device 60 in the form of a blade or the like is provided at a distance to the mouth 49, against which the double yarn, which is being rotated, will move, and as a result, will, in each case, be cut at the same point. Thus a true twist is applied to the remaining double yarn 50 between the spool package 31 and the suction gripper 47. The cutting device 60 is arranged in front of the mouth 49 at such a distance that a secure holding of the double yarn 50 is ensured in the section between the cutting device 60 and the mouth 49.

The suction gripper 53, corresponding to suction gripper 47, is equipped with twisting devices and a cutting device 60. However, its mouth 55 does not have to correspond to the width of the spool package 31, like mouth 49, but must only have the size of the end 23 of the two grooves 21, 22 which are covered to form ducts.

If it is provided that the twisting devices 59 of the suction grippers 47 and 53 generate air whirls with the same rotating direction, a double yarn is obtained after the establishing of the spliced connection which, before and behind the spliced point, has a twist in the opposite direction which can open up similar to a false twist. If the lengths provided with this twist have at least approximately the same size, this twist can be opened up almost completely. However, if the double yarns 50 and 56 are rotated by means of the twisting devices 59 of the suction grippers 47, 53 in opposite directions, a true twist remains in the double yarn after the spliced connection was made. If this twist is in the opposite direction to the future twisted-yarn twist by means of which the double yarn of the spool package 31 is made into a twisted yarn, in this case also, the twist is largely opened up.

In FIG. 2, it is also shown by means of a dotted line, where the double yarn 26 extends when it is taken over again by the spinning unit; i.e., when the spool package 31 again rests against the wind-up shaft 32 and is driven by it.

Although the present invention has been described and illustrated in detail, it is to be clearlY understood that the same is by way of illustration and examPle only, and is not to be taken by way of limitation. The spirit and scope of the present invention are to be limited only by the terms of the appended claims.

What is claimed:

1. A process for piecing newly spun double prestrengthened yarn being supplied by a spinning unit to previously spun double prestrengthened yarn on a spool package or the like, comprising the sequential steps at the spinning unit of:

providing strengthening twisting to both the newly spun and the previously spun double yarn ends, and subsequently splicing the newly spun and previously spun double yarn ends together, whereby the strengthening twisting facilitate handling of the yarn ends for the subsequent splicing operation at the spinning unit.

2. A process according to claim 1, wherein the strengthening twisting is provided by means of pneumatic elements applied to the double yarn taken off the spool package and to the newly spun double yarn.

3. A process according to claim 2, wherein the double yearn taken off the spool package and the newly spun double yarn, are each provided with a twist which is in the respective opposite direction over at least approximately the same lengths.

4. A process according to claim 2, wherein the double yarn taken off the spool package and the newly spun double yarn each receive a twist in the same direction which is opposite to subsequent twisted-yarn twist to be applied after the splicing.

5. A process according to claim 1, wherein the double yearn taken off the spool package and the newly spun double yarn, are each provided with a twist which is in the respective opposite direction over at least approximately the same lengths.

6. A process according to claim 1, wherein the double yarn taken off the spool package and the newly spun double yarn each receive a twist in the same direction which is opposite to subsequent twisted-yarn twist to be applied after the splicing.

7. Apparatus for piecing newly spun double prestrengthened yarn being supplied by a spinning unit to previously spun double prestrengthened yarn on a spool package or the like, comprising:

means for providing strengthening twisting to both the newly spun and the previously spun double yarn ends, and means for splicing the newly spun and previously spun double yarn ends together after they have been provided with the strengthening twisting, whereby the strengthening twisting facilitates the handling of the double yarn ends during subsequent splicing operations at the spinning unit.

8. Apparatus for piecing newly spun double prestrengthened yarn according to claim 7, wherein the means for providing strengthening twisting includes suction grippers equipped with pneumatic twisting devices.

9. An apparatus according to claim 8, wherein the suction grippers are equipped with devices for generating a true twist at the respective ends of the double yarns.

10. An arrangement according to claim 9, wherein the suction grippers are equipped with devices for cutting the double yarn at a distance from their mouths.

11. An arrangement according to claim 10, wherein the twisting devices of both suction grippers have the same rotating direction.

12. An arrangement according to claim 10, wherein the twisting devices of the two suction grippers have twisting directions which are opposite.

13. An arrangement according to claim 9, wherein the twisting devices of both suction grippers have the same rotating direction.

14. An arrangement according to claim 9, wherein the twisting devices of the two suction grippers have twisting directions which are opposite.

15. An arrangement according to claim 8, wherein the twisting devices of both suction grippers have the same rotating direction.

16. An arrangement according to claim 8, wherein the twisting devices of the two suction grippers have twisting directions which are opposite.

* * * * *